US010889121B2

(12) United States Patent
Vinokur et al.

(10) Patent No.: US 10,889,121 B2
(45) Date of Patent: Jan. 12, 2021

(54) LIQUID DISPENSER

(71) Applicant: HP Indigo B.V., Amstelveen (NL)

(72) Inventors: Michael Vinokur, Ness Ziona (IL); Alex Lipnizkiy, Ness Ziona (IL); Shai Valdman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/461,482

(22) PCT Filed: Feb. 16, 2017

(86) PCT No.: PCT/EP2017/000225
§ 371 (c)(1),
(2) Date: May 16, 2019

(87) PCT Pub. No.: WO2018/149467
PCT Pub. Date: Aug. 23, 2018

(65) Prior Publication Data

US 2019/0358960 A1 Nov. 28, 2019

(51) Int. Cl.

| | |
|---|---|
| ***B41J 2/19*** | (2006.01) |
| ***B41J 2/175*** | (2006.01) |
| ***F15D 1/00*** | (2006.01) |

(52) U.S. Cl.
CPC ..... *B41J 2/17513* (2013.01); *B41J 2/19* (2013.01); *F15D 1/0005* (2013.01)

(58) Field of Classification Search
None
See application file for complete search history.

(56) References Cited

U.S. PATENT DOCUMENTS

| | | | | |
|---|---|---|---|---|
| 2,973,866 | A | 3/1961 | Genter et al. | |
| 4,848,602 | A | 7/1989 | Yoshimura et al. | |
| 5,969,739 | A | 10/1999 | Altendorf et al. | |
| 6,733,589 | B2 | 5/2004 | Tobisawa | |
| 6,881,458 | B2 | 4/2005 | Ludwig et al. | |
| 8,215,745 | B2 * | 7/2012 | Ikeda | B41J 2/16508 347/29 |
| 9,044,939 | B2 | 6/2015 | Gonzales et al. | |
| 9,175,172 | B2 | 11/2015 | Regnier | |

(Continued)

FOREIGN PATENT DOCUMENTS

| | | |
|---|---|---|
| EP | 0153126 | 8/1985 |
| EP | 0765756 | 4/1997 |

(Continued)

OTHER PUBLICATIONS

DigiPrime® 060, "Technical Data Sheet", (2016) Michelman. Available at: < http://www.michelman.com/Digiprime/DigiPrime(r)-060/ >.

*Primary Examiner* — Alejandro Valencia
(74) *Attorney, Agent, or Firm* — Middleton Reutlinger

(57) ABSTRACT

In an example, a liquid dispenser is for dispensing liquid into a liquid reservoir with reduced foam formation. The liquid dispenser has a baffle element, guiding element and a discharge element. The baffle element is to receive liquid, the guiding element is to guide liquid from the baffle element to the discharge element, and the discharge element is to discharge liquid into the liquid reservoir. The baffle element, the guiding element and the discharge element are arranged in cascade to flow liquid from the baffle element to the discharge element.

13 Claims, 2 Drawing Sheets

(56) References Cited

U.S. PATENT DOCUMENTS

| | | | |
|---|---|---|---|
| 2005/0248636 | A1 | 11/2005 | Lui |
| 2008/0057433 | A1 | 3/2008 | Anderson et al. |
| 2014/0370252 | A1 | 12/2014 | Regnier |
| 2017/0014797 | A1* | 1/2017 | Iso ..... B01J 19/247 |

FOREIGN PATENT DOCUMENTS

| | | |
|---|---|---|
| EP | 1020293 | 7/2000 |
| EP | 3095604 | 11/2016 |
| WO | WO-2011131656 | 10/2011 |

* cited by examiner

LIQUID DISPENSER

BACKGROUND

Dispensing liquid into a liquid reservoir can cause foam formation. For example, when a gush of liquid falls from a height into a liquid reservoir already including fluid, the gush of liquid flushes air bubbles into the fluid and, thereby, generates foam. Foam can, for example, rapidly fill up the liquid reservoir causing foam and/or liquid spilling over.

BRIEF DESCRIPTION OF THE DRAWINGS

Examples will be described, by way of example only, with reference to the accompanying drawings in which corresponding reference numerals indicate corresponding parts and in which:

FIG. 4*a* and FIG. 4*b* show block diagrams of example methods of dispensing, by a liquid dispenser, liquid into a liquid reservoir with reduced foam formation.

Figure 1A:
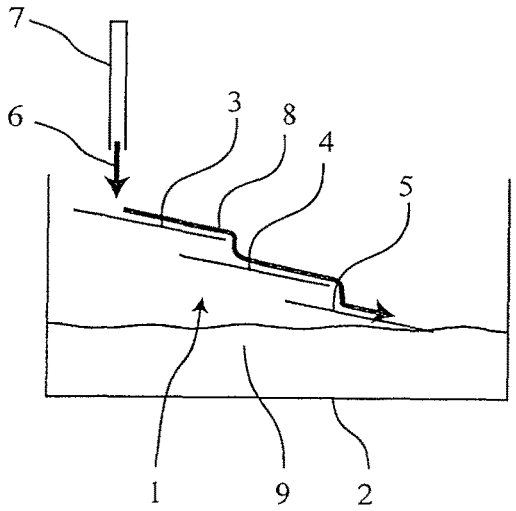
FIG. 1*a* and FIG. 1*b* schematically illustrate example liquid dispensers for dispensing liquid into a liquid reservoir with reduced foam formation.

Moreover the drawings provide examples and/or implementations consistent with the description; however, the description is not limited to the examples and/or implementations provided in the drawings.

DETAILED DESCRIPTION

The description refers to a liquid dispenser for dispensing liquid into a liquid reservoir with reduced foam formation. The description further refers to a printing system having a liquid reservoir and a liquid dispenser. The description further refers to a method of dispensing, by the liquid dispenser, liquid into the liquid reservoir with reduced foam formation.

An example liquid dispenser for dispensing liquid into a liquid reservoir with reduced foam formation has a baffle element, guiding element and a discharge element. The baffle element is configured to receive liquid. The guiding element is configured to guide liquid from the baffle element to the discharge element. The discharge element is configured to discharge liquid into the liquid reservoir. The baffle element, the guiding element and the discharge element are arranged in cascade, which is configured to automatically flow liquid received by the baffle element from the baffle element to the discharge element.

An example printing system has a liquid reservoir and a liquid dispenser for dispensing liquid into the liquid reservoir with reduced foam formation. The liquid dispenser has a baffle element, guiding element and a discharge element. The baffle element is configured to receive liquid, the guiding element is configured to guide liquid from the baffle element to the discharge element, and the discharge element is configured to discharge liquid into the liquid reservoir. The baffle element, the guiding element and the discharge element are arranged in cascade to (automatically) flow liquid from the baffle element to the discharge element. For example, the printing system includes a 2D printer for printing liquid ink on a print medium or a 3D printer for printing priming liquid when printing a 3D object on a printing bed. For example the dispensed liquid is liquid ink or priming liquid.

An example method of dispensing, by an example liquid dispenser, liquid into a liquid reservoir includes receiving, by the baffle element, liquid. The example method further includes guiding, by the guiding element, liquid from the baffle element to the discharge element. The example method further includes discharging, by the discharge element, liquid into the liquid reservoir. The liquid dispenser has a baffle element, guiding element and a discharge element. The baffle element, the guiding element and the discharge element are arranged in cascade. The cascade can be configured to (automatically) flow liquid from the baffle element to the discharge element.

The cascade includes the baffle element, the guiding element and the discharge element and, thus, builds a chain of neighboring elements to guide liquid from a first element, i.e. the baffle element, to a next one of the elements, i.e. the guiding element, and towards a last element, i.e. the discharge element, which discharges the liquid into the liquid reservoir. The baffle element, the guiding element and the discharge element, for example, reduce a flow speed of liquid to be filled into the liquid reservoir. For example, the liquid can descend via the cascade into the liquid reservoir, in particular without falling from a height.

Therefore, the cascade reduces foam formation when the liquid enters liquid already present in the liquid reservoir, in some examples. Furthermore, for example, the surface of liquid flowing from the baffle element via the guiding element to the discharge element enables foam bubbles to collapse until the liquid arrives at the liquid reservoir. This also reduces foam formation in the liquid reservoir.

In some examples, the liquid is priming liquid or liquid ink of a printing system. Foam of such liquid, for example, can disturb a printing process in that, for example, bubbles prevent from sufficient wetting by liquid. Foam also can, for example, prevent a pump from sucking sufficient liquid. For example, the liquid circulates in the printing system, wherein the reservoir is used to feed the printing system with the liquid. For example, a surplus of liquid from a printing process can be returned to the reservoir via the liquid dispenser, wherein the liquid dispenser reduces foam formation in the reservoir.

To achieve, e.g. a compact liquid dispenser, in some examples, the dispenser has (exactly) one guiding element (arranged between the baffle element and the discharge element). In these examples, the cascade has three elements, the baffle element, one guiding element and the discharge element. In these examples, the liquid flows in a three-stage manner into the liquid reservoir in that the baffle element directly passes received liquid on the guiding element, the guiding element directly passes the liquid on the discharge element and the discharge element discharges the liquid to the reservoir.

In some examples, the liquid dispenser has two or three or more guiding elements arranged between the baffle element and the discharge element, i.e. the cascade has four or five or more elements in these examples.

In some examples, a total vertical height of the liquid dispenser can be adapted by mounting and/or removing, e.g., one, two or more (further) guiding elements to the cascade (i.e. by arranging them between the baffle element and the discharge element).

In some examples, the liquid dispenser has a hinge to adjust an angle between the baffle element and the guiding element. In some examples, the liquid dispenser has a hinge to adjust an angle between the guiding element and the discharge element. In some examples having two or more guiding elements, the liquid dispenser has a hinge to adjust an angle between two (neighboring) guiding elements.

In some examples, adjusting angle(s) between one or more of the baffle element, the guiding element and the discharge element allows for adapting an overall height of the liquid dispenser. In some examples, adjusting angle(s) between one or more of the baffle element, the guiding element and the discharge element allows for adapting a vertical position of the discharge element, e.g. to correspond to a filling level in the liquid reservoir (in particular when in some of these examples a vertical position of the baffle element is fixed).

In some examples, the discharge element has a floating body. The floating body can flow in liquid present in the liquid reservoir. In some of these examples, a vertical position of the discharge element is automatically adjusted, by the floating body creating buoyancy when floating in liquid, to correspond to a liquid level in the liquid reservoir. The floating body can include cork, cellular plastic, plastic foam and/or a hollow body, for example.

For example, the floating body is dimensioned to compensate for a weight of the discharge element and, in some of these examples, to further compensate for at least a portion of the weights of the guiding element, by creating buoyancy by the floating body. This enables the discharge element to swim on the surface of the liquid in the liquid reservoir. For example, the floating body is dimensioned to raise the discharge element at the most up to 1 mm, 5 mm, 10 mm or 20 mm above surface of the liquid in the reservoir. This allows for prevent the liquid from falling too high and, thereby allows for reducing foam formation.

In some examples, the baffle element, the guiding element and the discharge element are vertically spaced from one another. In these examples, the dispenser is configured to build a waterfall of liquid flowing stair-like from the baffle element over the one or more guiding elements to the discharge element. In these examples, the liquid flows down a stair build by the baffle element, the guiding element and the discharge element, wherein the liquid freely falls down a certain height when flowing from one of these elements to a next one of these elements.

In some of these examples, vertical distances between the respectively vertically spaced baffle element, the guiding element and the discharge element can be adapted, e.g. by hinges joining these elements, to adapt an overall height of the liquid dispenser. For example, by adapting the vertical distances, a vertical position of the discharge element can be adapted to correspond to a variable filling level in the liquid reservoir (in particular when in some of these examples a vertical position of the baffle element is fixed).

In some examples, the baffle element, the guiding element and/or the discharge element has a plate. The plate can be configured to channel liquid on a top surface of the plate. For example, a plate of the baffle element can receive liquid, e.g. from a liquid hose or a pump outlet, and divert the liquid to the next element along the cascade, i.e. to the guiding element. For example, a plate of a guiding element can receive liquid from the baffle element or from a preceding guiding element of the cascade and guide the liquid to the discharge element or to a succeeding guiding element of the cascade. In some examples, the plate of the baffle element, the guiding element and/or the discharge element is flat. In some examples, the plate of the baffle element has a bend defining a first plate portion to receive liquid and a second plate portion to divert the liquid to the guiding element.

In some examples, the plates of the baffle element, the guiding element and the discharge element being arranged in cascade and form a stairway for the liquid. This allows the liquid dispenser to act as a waterfall for the liquid, for example.

In some examples, the baffle element is a plate and/or the guiding element is a plate. In some examples, the discharge element is a plate or the discharge element is a plate mounted on a floating body. In some examples, the liquid dispenser is substantially build up by plates representing the baffle element, the guiding element and the discharge element, which plates are joined by hinges, wherein the discharge element further has a floating body.

In some examples, the baffle element has a fastening device to fasten the liquid dispenser to the liquid reservoir. For examples, a source or outlet of liquid to be filled in the reservoir, e.g. a hose and/or pump outlet, can be mounted in a fixed position relative to liquid dispenser and, thus, also to the liquid reservoir, regardless of an actual filling level of the reservoir. For example, the liquid dispenser reduces form formation regardless of a height difference between the source or outlet of liquid and the filling level of the reservoir, as the liquid flows along the cascade of the baffle element, the guiding element and the discharge element into the reservoir.

As described before, in some examples the liquid dispenser automatically adapts to an actual filling level of the liquid reservoir in that the discharge element flows on the liquid in the reservoir and angle(s) between the baffle element, the guiding element and/or the discharge element (automatically) adapt by lifting or lowering the discharge element by the floating body. liquid Now referring to FIG. 1*a*, an example liquid dispenser I is configured to dispense liquid into a liquid reservoir 2. The liquid dispenser I has a baffle element 3, a guiding element 4 and a discharge element 5. The baffle element 3, the guiding element 4 and the discharge element 5 are arranged in (a stair-like) cascade, wherein the guiding element 4 is arranged between the baffle element 3 and the discharge element 5 in a horizontal direction and also in a vertical direction. The baffle element 3 is configured to receive a gush 6 of liquid, e.g. from a liquid hose 7 (external to the liquid dispenser I), and to divert the liquid into the direction of the guiding element 4. The guiding element 4 is configured to guide liquid from the baffle element 3 to the discharge element 5. The discharge element 5 is configured to discharge liquid into the liquid reservoir 2, wherein the discharge element 5 is configured to immerse into liquid 9 present in the liquid reservoir 2.

To automatically flow liquid from the baffle element 3 via the guiding element 4 to the discharge element 5, each of these elements has an inclination to let liquid naturally flow, i.e. driven by gravity, from the baffle element 3 to the guiding element 4 and, correspondingly, from the guiding element 4 to the discharge element 5, where the liquid discharges (also driven by gravity) from the discharge element 5 into the reservoir 2. For example, the liquid flows like a waterfall 8 from the baffle element 3 towards the discharge element 5.

Figure 1B:
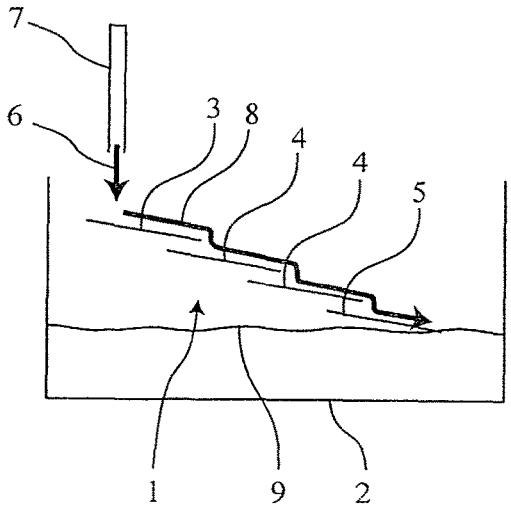

An example liquid dispenser 10 exemplarily shown in FIG. 1*b* distinguishes from the liquid dispenser I of FIG. 1*a* in that this example liquid dispenser 10 has two or more guiding elements 4 arranged in cascade between the baffle element 3 and the discharge element 5.

An example liquid dispenser 21 illustrated in FIG. 2 distinguishes from the liquid dispenser I shown in FIG. 1*a* as follows. The liquid dispenser 21 has a (first) hinge 27 joining the baffle element 23 and the guiding element 24. Furthermore, the liquid dispenser 21 has a (second) hinge 27 joining the guiding element 24 and the discharge element 25. Furthermore, the discharge element 25 has a floating body 26 made of a hollow body or cellular plastics. The liquid dispenser 21 (automatically) adjusts to a filling level 28 of liquid in the reservoir 22, in that the floating body 26 generates buoyancy when floating in the liquid in the reservoir 22. As indicated by an arrow in FIG. 2, the floating body 26 rises and lowers the discharge element 25 when the filling level 28 in the reservoir 22 increases and decreases respectively. By rising and lowering the discharge element 25, an angle between the baffle element 23 and the guiding element 24 as well as an angle between the guiding element 24 and the discharge element 25 is (automatically) adjusted.

The baffle element 23, the guiding element 24 and the discharge element 25 are composed of plates 23, 24, 25 to channel liquid on the plates' 23, 24, 25 surfaces. In order to divert the received gush 6 of liquid, the plate 23 of the baffle element 23 has a bend defining a first (e.g. vertical) plate portion 23*a* to receive the gush 6 of liquid and a second plate portion 23*b*, which is under an angle relative to the first plate portion 23*a*, to divert the liquid towards the guiding element 24. In order to allow the liquid dispenser 21 to adapt to the filling level 28, the plate 23 of the baffle element 24 and the plate 24 of the guiding element 24 are vertically spaced from one another, and also the plate 25 of the discharge element 25 and the plate 24 of the guiding element 24 are vertically spaced from one another. Thereby, the liquid dispenser 21 forms a stairs-like structure to flow the liquid like a waterfall 8.

The liquid dispenser 21 further has fastening device 29. This allows to mount the liquid dispenser 21 to the liquid reservoir 21. For example, this allows to mount the liquid dispenser 21 inside the liquid reservoir 21, wherein the baffle element 23 is a fixed ending and the discharge element 25 is a free ending of the liquid dispenser 21, as the discharge element 25 is configured to (automatically) adapt its vertical position to the filling level 28 of liquid in the reservoir 21.

Figure 2:
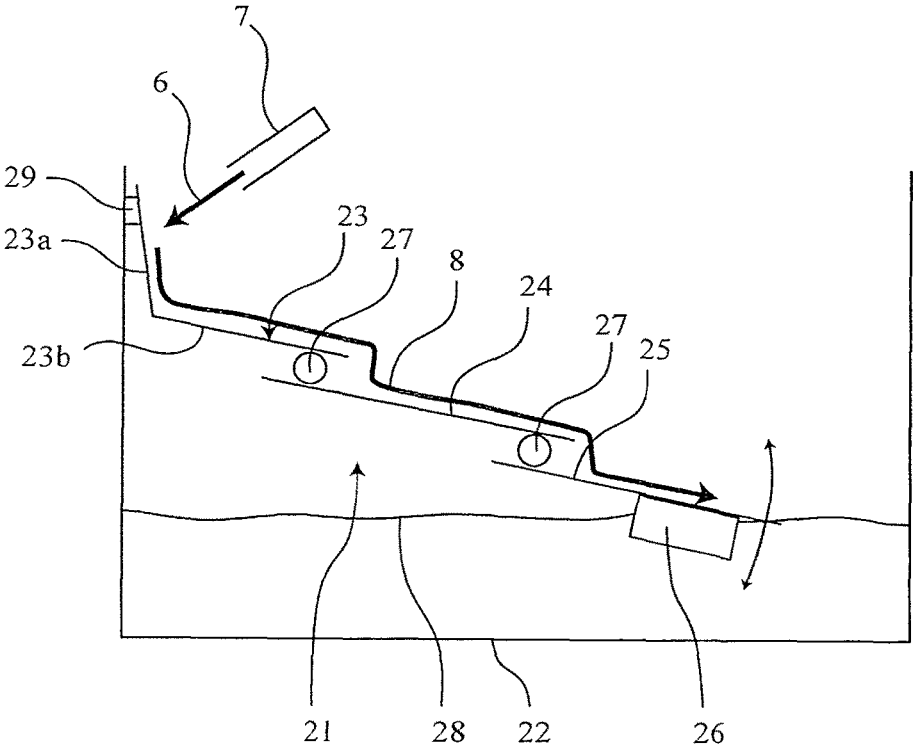
FIG. 2 is a schematic illustration of a still further example liquid dispenser for dispensing liquid into a liquid reservoir with reduced foam formation.
Figure 3:
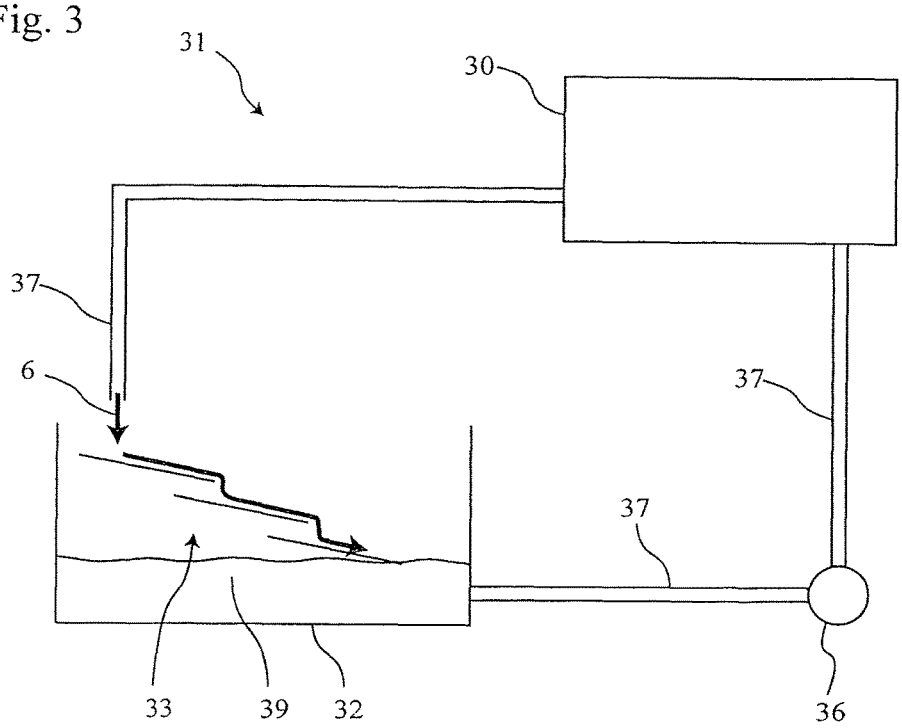
FIG. 3 is a schematic illustration of an example printing system with a liquid dispenser for dispensing liquid into a liquid reservoir with reduced foam formation.

FIG. 3 illustrates an example printing system 31 with a printing device 30 to print. For example, the printing device 30 includes 2D printer for printing liquid ink on a print medium or a 3D printer for printing priming liquid when printing a 3D object on a printing bed. In the example printing system 31, a liquid 39, e.g. liquid ink or priming liquid, is circulated, by a pump 36, between a liquid reservoir 32 and a printing device 30. The liquid 39 is returned from the printing device 30 to the liquid reservoir 32 via a hoses 37, which spouts a gush 6 of liquid 39. In order to reduce foam formation of liquid 39 in the liquid reservoir 32, a liquid dispenser 33, e.g. as described with regard to FIG. 1*a*, 1*b* or 2, is arranged in the liquid reservoir 32. The liquid dispenser 33 receives, by its baffle element, the gush 6 of liquid 39 and discharges, by its discharge element, the liquid 39 into the liquid reservoir 32.

Figure 4A:
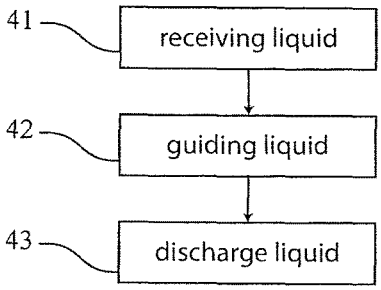
Figure 4A:
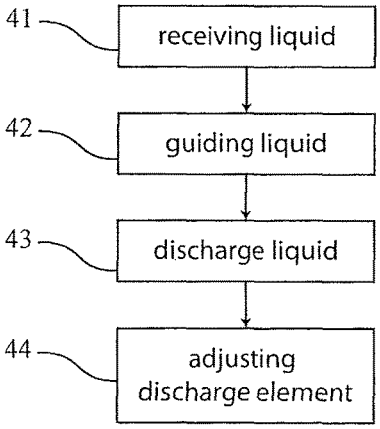

FIG. 4*a* illustrates an example method of dispensing, e.g. by a liquid dispenser as illustrated in FIG. 1*a*, FIG. 1*b*, FIG. 2 or FIG. 3, liquid into a liquid reservoir. The example method includes receiving, in block 41, by a baffle element, liquid. The example method further includes guiding, in block 42, by guiding element, liquid from the baffle element to a discharge element. The example method further includes discharging, in block 43, by the discharge element, liquid into the liquid reservoir.

FIG. 4*b* illustrates an example method of dispensing, e.g. by a liquid dispenser as illustrated in FIG. 2 or FIG. 3, liquid into a liquid reservoir. The example method includes receiving, in block 41, by a baffle element, liquid. The example method further includes guiding, in block 42, by guiding element, liquid from the baffle element to a discharge element. The example method further includes discharging, in block 43, by the discharge element, liquid into the liquid reservoir. The example method further includes (automatically) adjusting, by a floating body, a vertical position of the discharge element to correspond to a liquid level in the liquid reservoir.

Although some examples of methods and products have been described herein, other variations are generally within the scope of this description. As will be appreciated, the description generally contemplates various implementations fairly falling within the scope of the appended claims either literally or under the doctrine of equivalents.

The invention claimed is:

1. A liquid dispenser for dispensing liquid into a liquid reservoir with reduced foam formation, the liquid dispenser comprising a baffle element, a guiding element a discharge element, and a hinge between the baffle element and the guiding element to adjust an angle therebetween;

wherein the baffle element is to receive liquid, the guiding element is to guide liquid from the baffle element to the discharge element, and the discharge element is to discharge liquid into the liquid reservoir; and wherein the baffle element, the guiding element and the discharge element are arranged in cascade to flow liquid from the baffle element to the discharge element, and wherein the baffle element and the guiding element are vertically spaced from one another and the discharge element and the guiding element are vertically spaced from one another to form a waterfall-structure for the liquid.

2. The liquid dispenser according to claim 1, further comprising an additional hinge to adjust an angle between the discharge element and the guiding element.

3. The liquid dispenser according to claim 1, wherein the discharge element comprises a floating body to automatically adjust a vertical position of the discharge element to correspond to a liquid level in the liquid reservoir.

4. The liquid dispenser according to claim 1, wherein the baffle element, the guiding element and the discharge element comprise plates to channel liquid.

5. The liquid dispenser according to claim 1, wherein the baffle element comprises a fastening device to fasten the liquid dispenser to the liquid reservoir.

6. The liquid dispenser according to claim 1, wherein the liquid is a liquid ink or a priming liquid of a printing system.

7. A printing system comprising a liquid reservoir and a liquid dispenser for dispensing liquid into the liquid reservoir with reduced foam formation;

wherein the liquid dispenser comprises a baffle element, a guiding element, a discharge element, and a hinge between the baffle element and the guiding element to adjust an angle therebetween;

wherein the baffle element is to receive liquid, the guiding element is to guide liquid from the baffle element to the discharge element, and the discharge element is to discharge liquid into the liquid reservoir; and wherein the baffle element, the guiding element and the discharge element are arranged in cascade to flow liquid from the baffle element to the discharge element, and wherein the baffle element and the guiding element are vertically spaced from one another and the discharge element and the guiding element are vertically spaced from one another to form a waterfall-structure for the liquid.

8. The printing system according to claim 7, wherein the liquid dispenser further comprises an additional hinge to adjust an angle between the discharge element and the guiding element.

9. The printing system according to claim 7, wherein the discharge element comprises a floating body to automatically adjust a vertical position of the discharge element to correspond to a liquid level in the liquid reservoir.

10. A method of dispensing, by a liquid dispenser, liquid into a liquid reservoir with reduced foam formation;

the liquid dispenser comprising a baffle element, a guiding element, a discharge element, and a hinge between the baffle element and the guiding element to adjust an angle therebetween;

wherein the baffle element, the guiding element and the discharge element are arranged in cascade, and wherein the baffle element and the guiding element are vertically spaced from one another and the discharge element and the guiding element are vertically spaced from one another to form a waterfall-structure for the liquid;

the method comprising:

receiving, by the baffle element, liquid, guiding, by the guiding element, liquid from the baffle element to the discharge element, and discharging, by the discharge element, liquid into the liquid reservoir.

11. The method according to claim 10, wherein the liquid dispenser further comprises an additional hinge to adjust an angle between the discharge element and the guiding element.

12. The method according to claim 10, wherein the discharge element comprises a floating body; and wherein the method further comprises automatically adjusting a vertical position of the discharge element to correspond to a liquid level in the liquid reservoir.

13. The method according to claim 10, wherein the liquid is a liquid of a printing system.

* * * * *